US012209825B2

(12) United States Patent
Huang et al.

(10) Patent No.: US 12,209,825 B2
(45) Date of Patent: Jan. 28, 2025

(54) WATER COOLING DEVICE AND COLLECTOR THEREOF

(71) Applicant: DELTA ELECTRONICS, INC., Taoyuan (TW)

(72) Inventors: Yu-Jei Huang, Taoyuan (TW); Li-Kuang Tan, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 18/453,327

(22) Filed: Aug. 22, 2023

(65) Prior Publication Data

US 2023/0392882 A1 Dec. 7, 2023

Related U.S. Application Data

(62) Division of application No. 17/337,444, filed on Jun. 3, 2021, now Pat. No. 11,788,802.

(30) Foreign Application Priority Data

Sep. 29, 2020 (CN) ..... 202011055008.X

(51) Int. Cl.
*F28F 9/02* (2006.01)
*F28D 1/053* (2006.01)

(52) U.S. Cl.
CPC ..... *F28F 9/0278* (2013.01); *F28D 1/05391* (2013.01); *F28F 9/0282* (2013.01)

(58) Field of Classification Search
CPC .... F28F 9/0278; F28F 9/0282; F28D 1/05391
USPC ..... 165/174
See application file for complete search history.

(56) References Cited

U.S. PATENT DOCUMENTS 4,709,689 A * 12/1987 Simcox ..... F24S 80/30 165/173
5,023,695 A * 6/1991 Umezawa ..... H01L 23/4735 257/714
5,349,831 A * 9/1994 Daikoku ..... H01L 23/427 165/80.4
7,112,297 B2 * 9/2006 Williams ..... B29C 45/14836 264/277
7,511,957 B2 * 3/2009 Campbell ..... H01L 23/4735 257/714
7,819,177 B2 * 10/2010 Beamer ..... F28F 9/0246 165/174

(Continued)

FOREIGN PATENT DOCUMENTS

CN 1521591 A 8/2004
TW 1688331 B 3/2020

*Primary Examiner* — Jon T. Schermerhorn, Jr.
(74) *Attorney, Agent, or Firm* — CKC & Partners Co., LLC

(57) ABSTRACT

A water cooling device includes a first collector, a second collector and a plurality of tubes. The first collector includes a receiving chamber and a plurality of distribution chamber. The receiving chamber has an inlet for receiving a working fluid. Each of the distribution chambers includes a first wall portion and a second wall portion opposite to the first wall portion. The first wall portion has an opening communicating with the receiving chamber. The second wall portion has an outlet. Each of the tubes is connected to the outlet of one of the distribution chambers on one end, and is connected to the second collector on another end.

6 Claims, 8 Drawing Sheets

(56) References Cited

U.S. PATENT DOCUMENTS

| | | | | |
|---|---|---|---|---|
| 7,967,061 | B2 * | 6/2011 | Gorbounov | F25B 39/028 165/174 |
| 8,037,929 | B2 * | 10/2011 | Higashiyama | F28F 9/0246 165/172 |
| 8,225,853 | B2 * | 7/2012 | Macri | F28D 1/05391 165/174 |
| 8,570,744 | B2 * | 10/2013 | Rau | H01L 23/473 361/720 |
| 8,587,943 | B2 * | 11/2013 | Barina | H01L 23/427 361/720 |
| 9,158,348 | B2 | 10/2015 | Berk et al. | |
| 10,326,186 | B2 * | 6/2019 | Lee | F28F 9/22 |
| 10,443,957 | B2 * | 10/2019 | Kikuchi | H05K 7/20254 |
| 10,520,259 | B2 * | 12/2019 | Chialastri | G06F 1/20 |
| 10,798,851 | B1 * | 10/2020 | Weber | H05K 7/20327 |
| 11,310,935 | B2 * | 4/2022 | Jia | F28D 1/035 |
| 2011/0000255 | A1 * | 1/2011 | Taras | F28F 9/0273 165/173 |
| 2013/0135812 | A1 | 5/2013 | Barina et al. | |
| 2013/0199288 | A1 * | 8/2013 | Goenka | F28F 9/0263 73/202 |
| 2017/0146273 | A1 * | 5/2017 | Spitzner | H05K 7/20336 |
| 2021/0310443 | A1 * | 10/2021 | Guillou | F28F 9/0246 |

* cited by examiner

WATER COOLING DEVICE AND COLLECTOR THEREOF

RELATED APPLICATIONS

This application is a divisional application of the U.S. application Ser. No. 17/337,444, filed Jun. 3, 2021, which claims priority to China Application Serial Number 202011055008.X, filed Sep. 29, 2020, the disclosure of which is incorporated herein by reference in its entirety.

BACKGROUND

Technical Field

The present disclosure relates to a water cooling device and collector thereof.

Description of Related Art

In recent years, server devices see continued growth in the demand for memory, resulting in an increase in the number of memory modules being installed on the motherboard. When cooling the memory modules via water cooling, the memory modules are at differing distance to the inlet of the water cooling device. This would cause a disparity in the amount of water passing by and making heat exchange with each memory module, resulting in a variation of temperature across the memory modules. Generally speaking, memory modules positioned farther away from the inlet may have higher temperature due to relatively poor cooling efficiency.

SUMMARY

In view of the foregoing, one of the objects of the present disclosure is to provide a novel power supply device and conductive spring contact to resolve the aforementioned problem.

To achieve the objective stated above, in accordance with an embodiment of the present disclosure, a water cooling device includes a first collector, a second collector and a plurality of first tubes. The first collector includes a receiving chamber and a plurality of distribution chamber. The receiving chamber has an inlet for receiving a working fluid. Each of the distribution chambers includes a first wall portion and a second wall portion opposite to the first wall portion. The first wall portion has an opening communicating with the receiving chamber. The second wall portion has an outlet. Each of the first tubes is connected to the outlet of one of the distribution chambers on one end, and is connected to the second collector on another end.

In one or more embodiments of the present disclosure, a size of the opening is positively correlated with a distance from the opening to the inlet of the receiving chamber.

In one or more embodiments of the present disclosure, at least one of the distribution chambers further includes a duct. The duct protrudes from the first wall portion towards the second wall portion.

In one or more embodiments of the present disclosure, the number of the distribution chamber with the duct is two or more than two, and two of the ducts have differing diameters, cross-sectional areas, lengths or inner surface roughness.

In one or more embodiments of the present disclosure, the receiving chamber is formed with at least one distribution groove. The distribution groove has a first end at the inlet of the receiving chamber and at least one second end at the opening of one of the distribution chambers.

In one or more embodiments of the present disclosure, the distribution groove is recessed into a wall portion of the receiving chamber.

In one or more embodiments of the present disclosure, the distribution groove is configured such that: (A) the at least one distribution groove is plural in number, and a size of the distribution groove is positively correlated with a distance from the opening corresponding to the distribution groove to the inlet of the receiving chamber; (B) a cross-sectional area of the distribution groove increases with increasing distance from the inlet of the receiving chamber; or (C) the at least one second end is plural in number, and a size of the second end is positively correlated with a distance from the opening corresponding to the second end to the inlet of the receiving chamber.

In one or more embodiments of the present disclosure, the water cooling device further includes a third collector and a plurality of second tubes. The first collector, the second collector and the third collector are arranged in sequence along a direction. The second tubes communicate with the second collector and the third collector.

In one or more embodiments of the present disclosure, the second collector has a plurality of first through-holes and a plurality of second through-holes. Each of the first through-holes is connected to one of the first tubes, and each of the second through-holes is connected to one of the second tubes.

In one or more embodiments of the present disclosure, the second collector has two inner walls opposite to each other and one or more partitions positioned between the two inner walls. An area between any two adjacent partitions, or between either of the inner walls and one of the partitions adjacent thereto, covers at least one of the first through-holes and at least one of the second through-holes.

In accordance with an embodiment of the present disclosure, a collector includes a receiving chamber and a plurality of distribution chamber. The receiving chamber has an inlet for receiving a working fluid. Each of the distribution chambers includes a first wall portion and a second wall portion opposite to the first wall portion. The first wall portion has an opening communicating with the receiving chamber. The second wall portion has an outlet.

In accordance with an embodiment of the present disclosure, a collector includes a housing. The housing has an inlet, a plurality of outlets and a wall portion. The inlet is configured to receive a working fluid. The wall portion has at least one distribution groove. The distribution groove has a first end at the inlet and at least one second end at one of the outlets.

In one or more embodiments of the present disclosure, the distribution groove is recessed into the wall portion.

In one or more embodiments of the present disclosure, the distribution groove is configured such that: (A) the at least one distribution groove is plural in number, and a size of the distribution groove is positively correlated with a distance from one of the outlets corresponding to the distribution groove to the inlet; (B) a cross-sectional area of the distribution groove increases with increasing distance from the inlet; or (C) the at least one second end is plural in number, and a size of the second end is positively correlated with a distance from one of the outlets corresponding to the second end to the inlet.

In sum, the collector of the present disclosure utilizes distribution chambers or distribution grooves to evenly distribute the received working fluid to the outlets, thereby making the amount of working fluid passing through the tubes substantially equal.

BRIEF DESCRIPTION OF THE DRAWINGS

To make the objectives, features, advantages, and embodiments of the present disclosure, including those mentioned above and others, more comprehensible, descriptions of the accompanying drawings are provided as follows.

DETAILED DESCRIPTION

Figure 1:
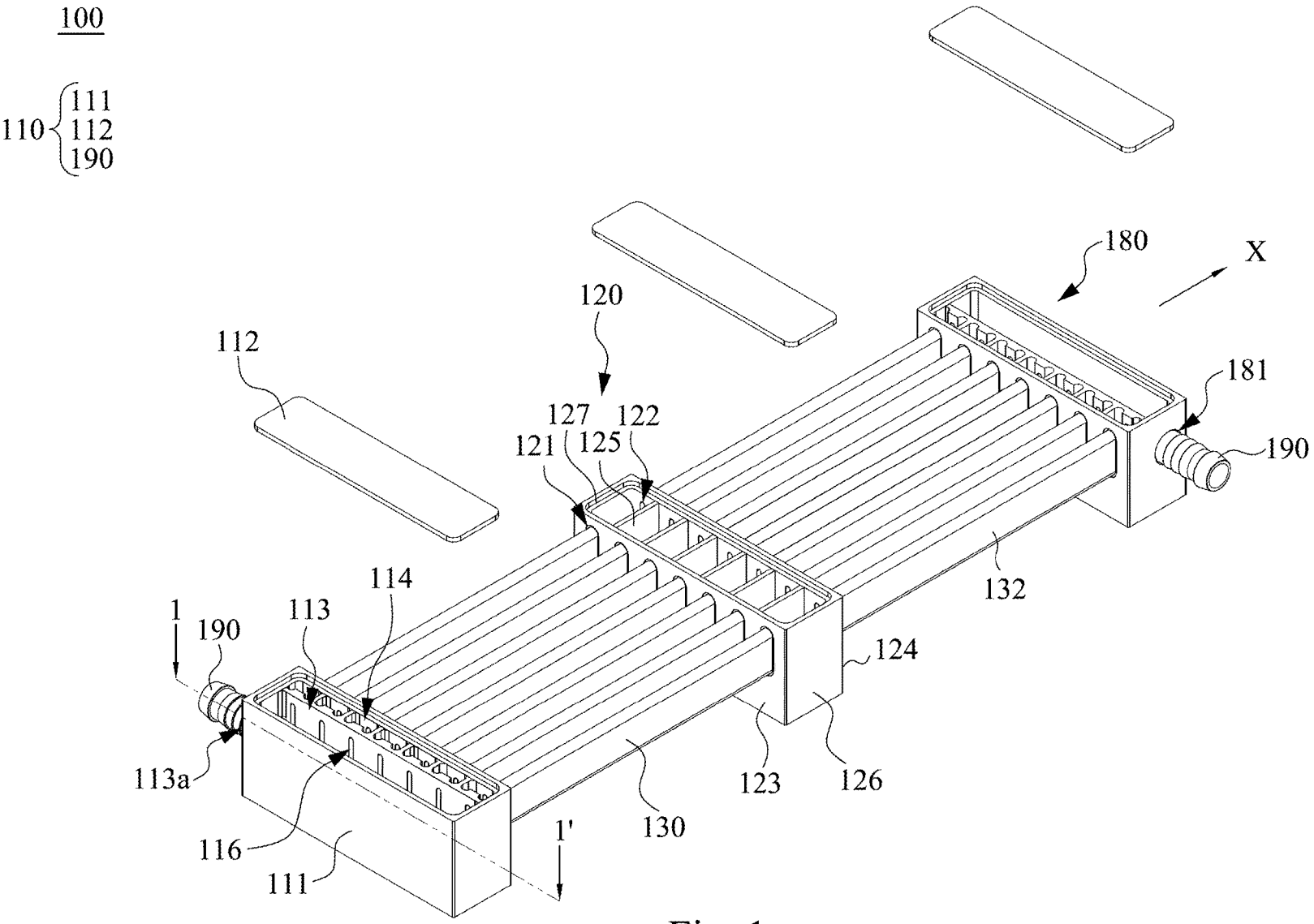
FIG. 1 illustrates an exploded view of a water cooling device in accordance with an embodiment of the present disclosure.

For the completeness of the description of the present disclosure, reference is made to the accompanying drawings and the various embodiments described below. Various features in the drawings are not drawn to scale and are provided for illustration purposes only. To provide full understanding of the present disclosure, various practical details will be explained in the following descriptions. However, a person with an ordinary skill in relevant art should realize that the present disclosure can be implemented without one or more of the practical details. Therefore, the present disclosure is not to be limited by these details.

In the present disclosure, the usage "A is positively correlated with B" means that when A increases, B increases as well, and when A decreases, B decreases as well.

Figure 2:
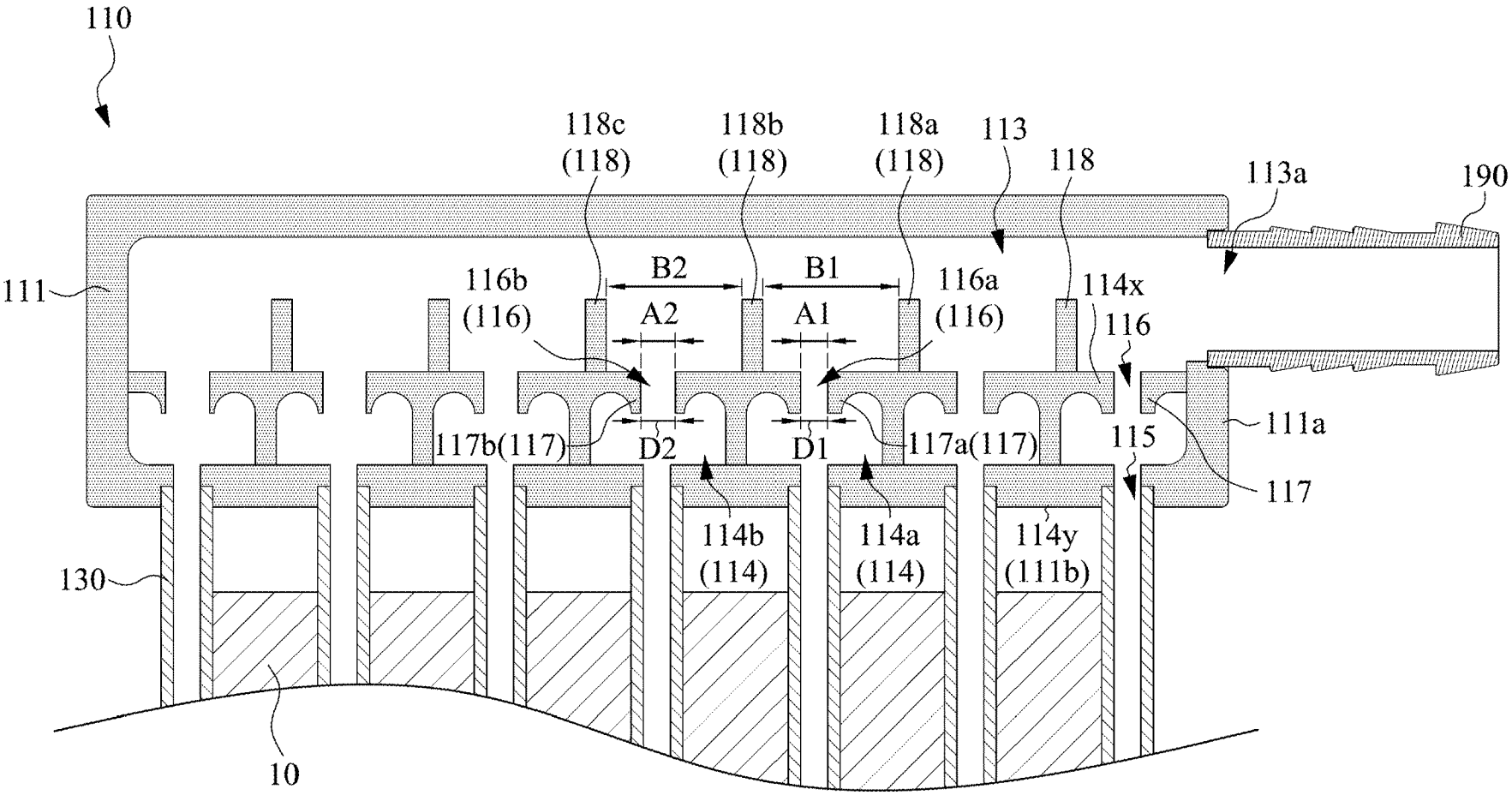
FIG. 2 illustrates an enlarged sectional view of the water cooling device shown in FIG. 1 taken along line segment 1-1'.

Reference is made to FIGS. 1 and 2. FIG. 1 illustrates an exploded view of a water cooling device 100 in accordance with an embodiment of the present disclosure. FIG. 2 illustrates an enlarged sectional view of the water cooling device 100 shown in FIG. 1 taken along line segment 1-1'. The water cooling device 100 serves to guide a working fluid (e.g., water) to make heat exchange with a plurality of memory modules 10 (e.g., DIMM; omitted in FIG. 1) and thereby cooling the memory modules 10. The water cooling device 100 includes a first collector 110, a second collector 120 and a plurality of first tubes 130 in fluid communication with one another. The first tubes 130 are separated from one another and are connected between the first collector 110 and the second collector 120. The side surfaces of the first tubes 130 are configured to make thermal contact with the memory modules 10. In some embodiments, the first tubes 130 are flat tubes. In some embodiments, the first tubes 130 include metal or other suitable thermally conductive materials.

The first collector 110 includes a housing 111 and a cover 112. The housing 111 is configured to accommodate the working fluid. The cover 112 covers the housing 111. The housing 111 includes a receiving chamber 113 and a plurality of distribution chambers 114. The receiving chamber 113 has an inlet 113*a* for receiving the working fluid. The inlet 113*a* is where the working fluid enters the water cooling device 100. The distribution chambers 114 are arranged on a side of the receiving chamber 113 and are in communication with the receiving chamber 113. The distribution chambers 114 are configured to distribute the working fluid to a plurality of outlets 115 each corresponding to one of the distribution chambers 114, such that the working fluid flows through the outlets 115 at substantially equal flow rate or flow velocity.

Specifically, each of the distribution chambers 114 includes a first wall portion 114*x* and a second wall portion 114*y* opposite to the first wall portion. The first wall portion 114*x* has an opening 116 communicating with the receiving chamber 113. The second wall portion 114*y* has the outlet 115.

For example, the inlet 113*a* and the outlets 115 are located on a first side wall 111*a* and a second side wall 111*b* of the housing 111 respectively. The outlets 115 are at differing distance from the inlet 113*a*. In addition, a fluid connector 190 may be formed on the outer side of the inlet 113*a* of the first collector 110. The first collector 110 may be connected to an external circulation system (not depicted) through the fluid connector 190.

Each of the first tubes 130 is connected to the outlet 115 of one of the distribution chambers 114 on one end, and is connected to the second collector 120 on another end, so as to convey the working fluid from the first collector 110 to the second collector 120.

The distribution chambers 114 or the outlets 115 thereof differ in structures or sizes. By virtue of said difference, the working fluid can flow through the outlets 115 at substantially equal flow rate or flow velocity, such that the first tubes 130 can have substantially equal cooling efficiency. Accordingly, the water cooling device 100 can provide substantially equal cooling for the memory modules 10.

Preferably, a size of the opening 116 of the distribution chamber 114 is positively correlated with a distance from the opening 116 to the inlet 113*a* of the receiving chamber 113. In other words, as the distance from the distribution chamber 114 to the inlet 113 increases, the size of the opening 116 (e.g., the width, height or cross-sectional area of the opening 116) of the distribution chamber 114 increases correspondingly. In an embodiment, the first collector 110 includes a first distribution chamber 114*a* with a first opening 116*a* and a second distribution chamber 114*b* with a second opening 116*b*. A distance from the first opening 116*a* to the inlet 113*a* is less than a distance from the second opening 116*b* to the inlet 113*a*. A cross-sectional area A1 of the first opening 116*a* is less than a cross-sectional area A2 of the second opening 116*b*.

Furthermore, in practice, at least one of the distribution chambers 114 may be formed with a duct 117. The opening 116 acts as the inlet of the duct 117. The duct 117 protrudes from the first wall portion 114*x* towards the second wall portion 114*y*. In cases where the number of the distribution chamber 114 with the duct 117 is two or more than two, two of the ducts 117 have differing diameters, cross-sectional areas, lengths or inner surface roughness. As the distance from the duct 117 to the inlet 113 increases, the diameter of the duct 117 increases, the cross-sectional area of the duct 117 increases, the length of the duct 117 decreases, or the inner surface roughness of the duct 117 decreases. In some embodiments, two or more design parameters of the duct 117 (e.g., diameter, cross-sectional area, length or inner surface roughness of the duct) may be changed simultaneously.

In an embodiment, the first distribution chamber 114*a* has a first duct 117*a* and the second distribution chamber 114*b* has a second duct 117*b*. A distance from the first duct 117*a* to the inlet 113*a* is less than a distance from the second duct 117*b* to the inlet 113*a*, and a diameter D1 of the first duct 117*a* is less than a diameter D2 of the second duct 117*b*.

Aside from the designs mentioned above, the first collector 110 may further include a plurality of partitions 118. The partitions 118 extend from the first wall portion 114*x* and along a direction away from the second wall portion 114*y*. An area between any two adjacent partitions 118, or an area between the inner walls of the receiving chamber 113 and one of the partitions 118 adjacent thereto, covers at least one opening 116. Preferably, the density of the partitions 118 decreases with increasing distance from the inlet 113*a* to even the flow rate in said areas. In a specific embodiment, the first collector 110 includes a first partition 118*a*, a second partition 118*b* and a third partition 118*c* at increasing distance from the inlet 113*a*. A distance B1 between the first partition 118*a* and the second partition 118*b* is less than a distance B2 between the second partition 118*b* and the third partition 118*c*.

Moreover, the water cooling device 100 may include a third collector 180 and a plurality of second tubes 132 as needed. The first collector 110, the first tubes 130, the second collector 120, the second tubes 132 and the third collector 180 are arranged in sequence along a direction X. The second tubes 132 are separated from one another, and the second tubes 132 communicate with both the second collector 120 and the third collector 180. The third collector 180 has an outlet 181 for discharging the working fluid. By this arrangement, the water cooling device 100 can be utilized to cool two rows of memory modules.

The inlet 113*a* and the outlet 181 of the water cooling device 100 may be arranged diagonally, on the same side of the water cooling device 100, or on opposite sides of the water cooling device 100. Another fluid connector 190 may be formed on the outer side of the outlet 181, and the water cooling device 100 may form a loop through the two fluid connectors 190.

In cases where the outlet 181 of the water cooling device 100 is not at the second collector 120, the second collector 120 may have a plurality of first through-holes 121 and a plurality of second through-holes 122. The first through-holes 121 and the second through-holes 122 are located on opposite side walls 123 and 124 of the second collector 120 respectively. Each of the first through-holes 121 is connected to one of the first tubes 130, and each of the second through-holes 122 is connected to one of the second tubes 132.

The second collector 120 may be formed with one or more partitions 125 as needed. The second collector 120 has two inner walls 126 and 127 opposite to each other. Each of the partitions 125 is positioned between the two inner walls 126 and 127 and is connected between the side walls 123 and 124. The partitions 125 divide the interior of the second collector 120 into a plurality of areas. The area between any two adjacent partitions 125, or the area between either of the inner walls 126 and 127 and one of the partitions 125 adjacent thereto, covers at least one of the first through-holes 121 and at least one of the second through-holes 122. In the illustrate embodiment, each area covers a single first through-hole 121 and a single second through-hole 122.

Figure 3:
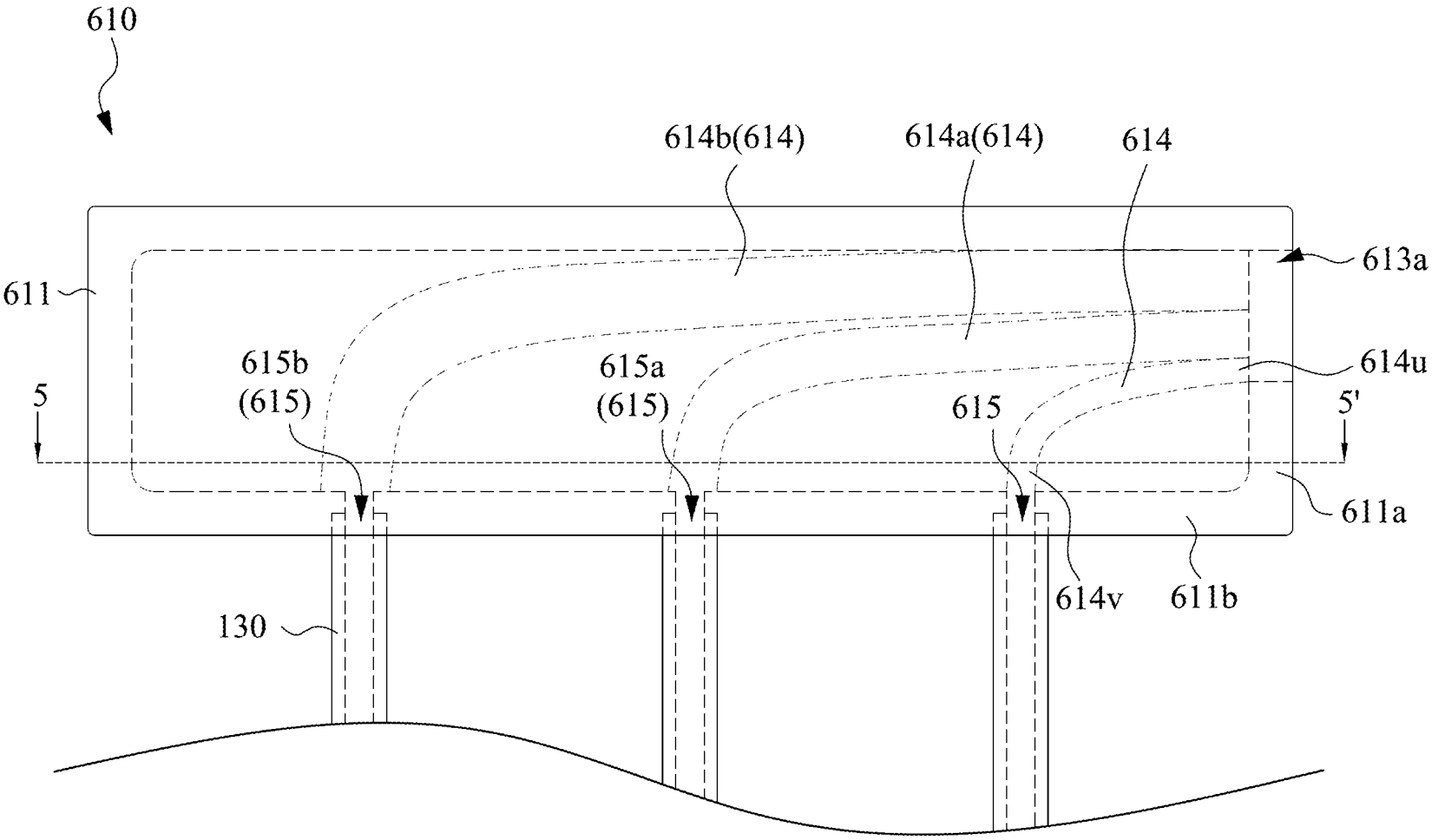
FIG. 3 illustrates a perspective top view of a water cooling device in accordance with another embodiment of the present disclosure.
Figure 4:
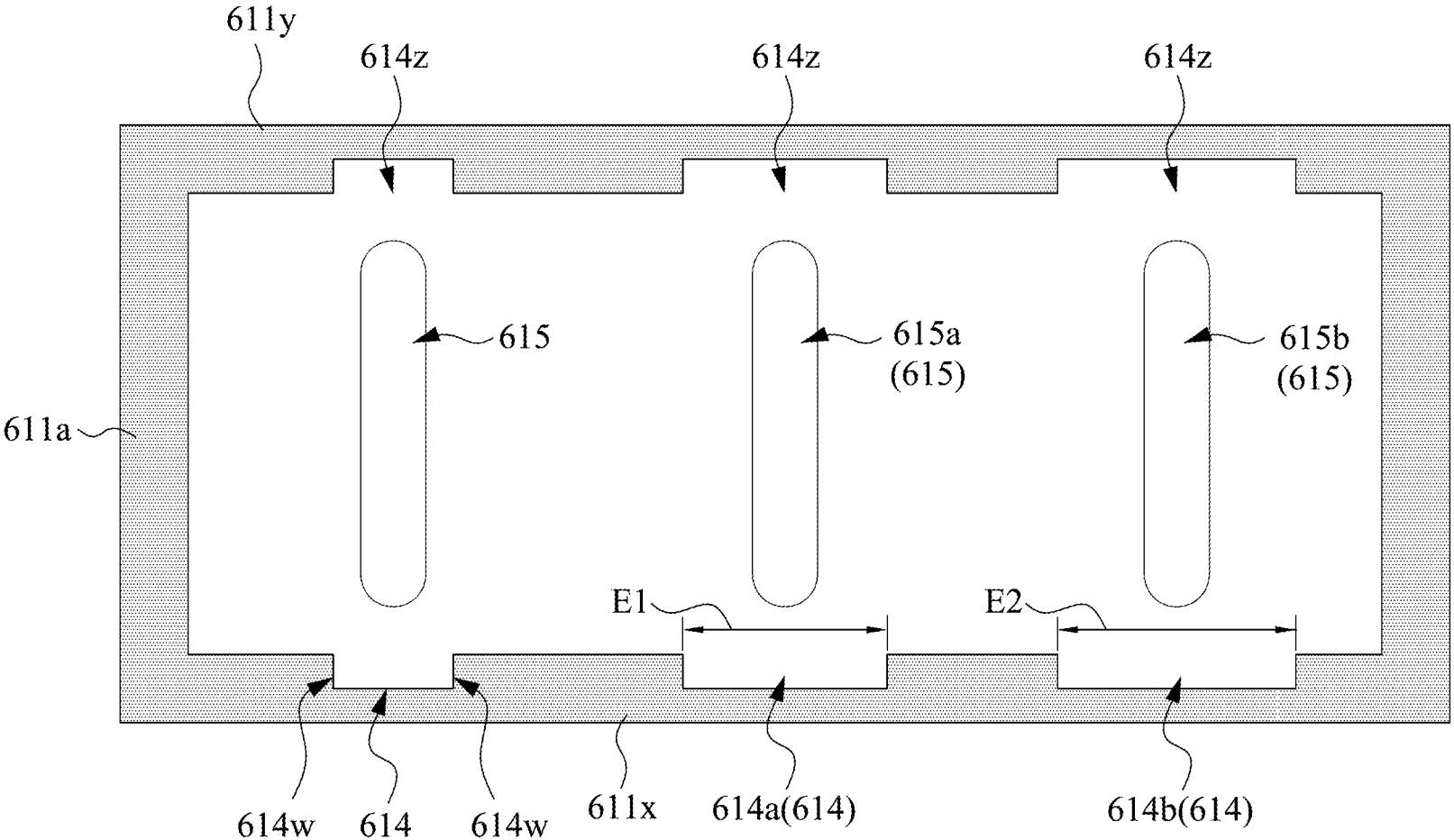
FIG. 4 illustrates a schematic sectional view of the water cooling device shown in FIG. 3 taken along line segment 5-5'.

Reference is made to FIGS. 3 and 4. FIG. 3 illustrates a perspective top view of a water cooling device in accordance with another embodiment of the present disclosure. FIG. 4 illustrates a schematic sectional view of the water cooling device shown in FIG. 3 taken along line segment 5-5'. Unlike the embodiments discussed previously, which rely on distribution chambers to distribute the working fluid, in the present embodiment, the first collector 610 has at least one distribution groove 614 for distributing the working fluid to a plurality of outlets 615. Specifically, the first collector 610 includes a housing 611, and the housing 611 has a first side wall 611*a*, a second side wall 611*b* different from the first side wall 611*a*, and a wall portion 611*x* connected to both the first side wall 611*a* and the second side wall 611*b*. The first side wall 611*a* has an inlet 613*a*, the second side wall 613*b* has the outlets 615. The wall portion 611*x* has one or more distribution grooves 614. Each of the distribution grooves 614 has a first end 614*u* at the inlet 613*a* and at least one second end 614*v* at one of the outlets 615.

In some embodiments, the wall portion 611*x* is at the bottom of the housing 611. In other words, the wall portion 611*x* is a bottom wall of the housing 611. In some embodiments, the distribution groove 614 is recessed into the wall portion 611*x*. In other words, the distribution groove 614 is depressed from the surface of the wall portion 611*x*. Alternatively, in some embodiments, the distribution groove includes sidewalls that protrude outward from the surface of the wall portion 611*x* to define the distribution groove.

The distribution grooves 614 have differing flow resistance. Specifically, the flow resistance of the distribution groove 614 increases as the distance from the outlet 615 corresponding to the distribution groove 614 to the inlet 613*a* increases. Consequently, the working fluid entering the first collector 610 through the inlet 613*a* can be evenly distributed to the outlets 615, thereby making the amount of working fluid passing through the first tubes 130 substantially equal.

In addition, in cases where the at least one distribution groove 614 is plural in number, a size of the distribution groove 614 is positively correlated with a distance from one of the outlets 615 corresponding to the distribution groove 614 to the inlet 613*a*. In other words, as the distance from the outlet 615 to the inlet 613*a* increases, the distribution groove 614 corresponding to the outlet 615 increases in size (e.g., the width, height or cross-sectional area of the distribution groove 614). For example, the first collector 610 includes a first outlet 615*a*, a second outlet 615*b*, a first distribution groove 614*a* extending between the inlet 613*a* and the first outlet 615*a*, and a second distribution groove 614*b* extending between the inlet 613*a* and the second outlet 615*b*. A distance from the first outlet 615*a* to the inlet 613*a* is less than a distance from the second outlet 615*b* to the inlet 613*a*. A width E1 of the first distribution groove 614*a* is less than a width E2 of the second distribution groove 614*b*.

Furthermore, the housing 611 includes a wall portion 611*y*, which is the top wall of the housing 611, and is opposite to the wall portion 611*x*. The wall portion 611*y* may be formed with at least one distribution groove 614*z*. The distribution groove 614*z* extends between the inlet 613*a* and one of the outlets 615. The housing 611 may include either the distribution groove 614 on the wall portion 611*x* or the distribution groove 614*z* on the wall portion 611*y*. Alternatively, the housing 611 may include both the distribution groove 614 and the distribution groove 614*z*.

Figure 5:
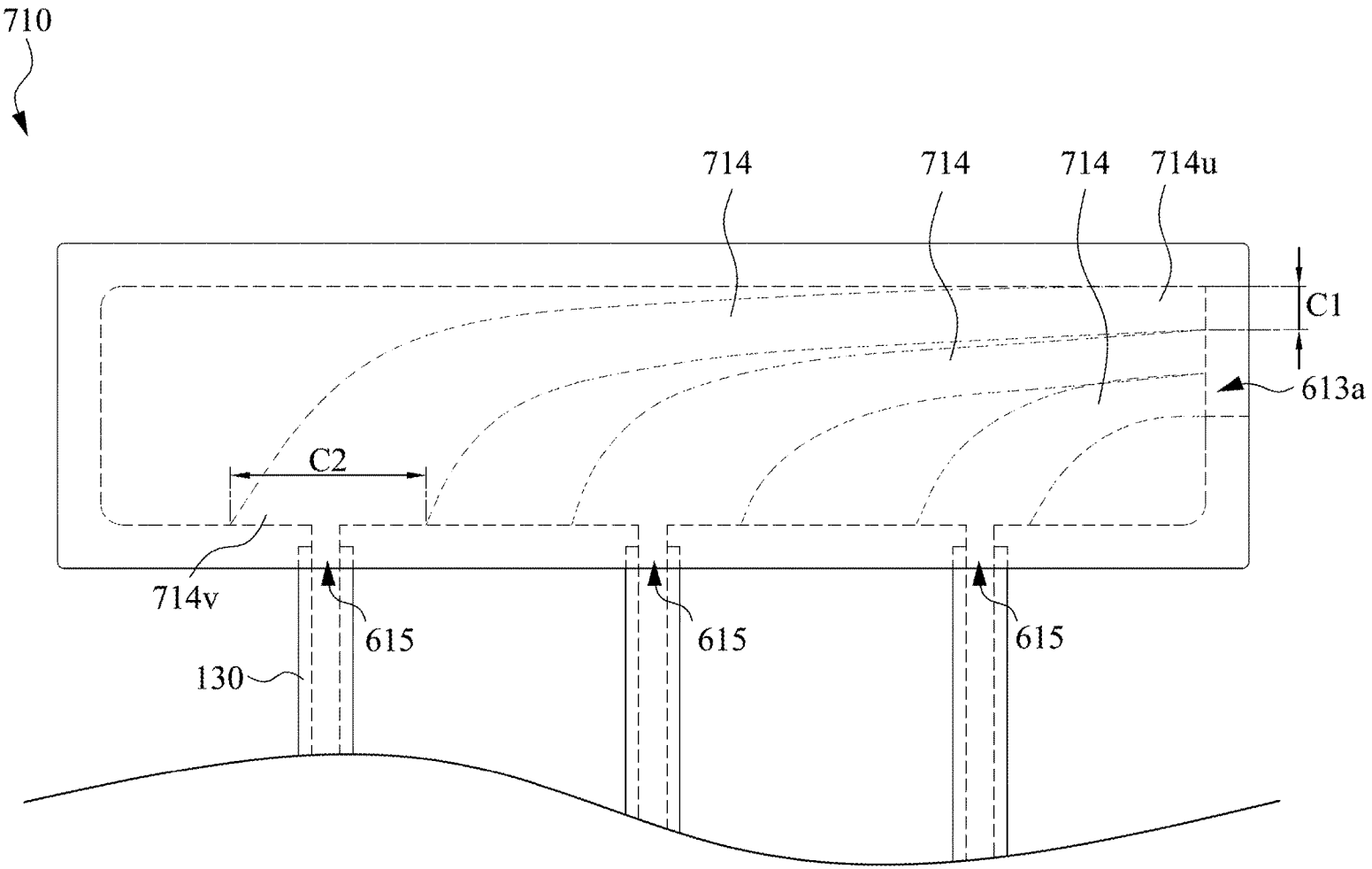
FIG. 5 illustrates a perspective top view of a water cooling device in accordance with another embodiment of the present disclosure.

Reference is made to FIG. 5, which illustrates a perspective top view of a water cooling device in accordance with another embodiment of the present disclosure. In the present embodiment, a cross-sectional area of the distribution groove 714 of the first collector 710 increases with increasing distance from the inlet 613*a*. Specifically, a cross-sectional area C1 of a first end 714*u* of the distribution groove 714 (at the inlet 613*a*) is less than a cross-sectional area C2 of a second end 714*v* of the distribution groove 714 (at one of the outlets 615). Preferably, the cross-sectional area of the distribution groove 714 gradually increases with increasing distance from the inlet 613*a*.

Figure 6:
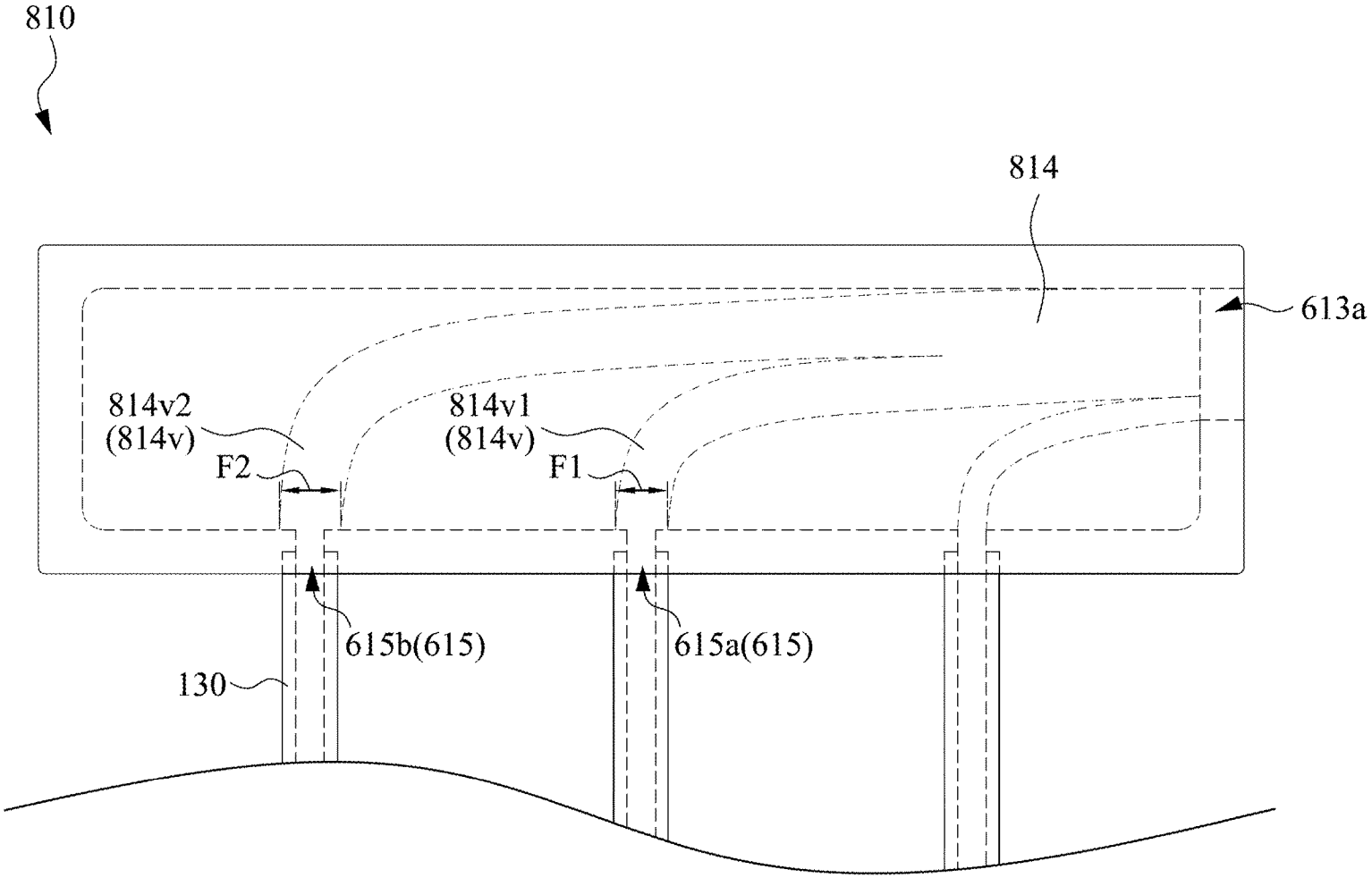
FIG. 6 illustrates a perspective top view of a water cooling device in accordance with another embodiment of the present disclosure.

Reference is made to FIG. 6, which illustrates a perspective top view of a water cooling device in accordance with another embodiment of the present disclosure. In the present embodiment, the distribution groove 814 of the first collector 810 has two or more second ends 814*v* (the distribution groove 814 is exemplified as having two second ends 814*v* in FIG. 6). A size of the second end 814*v* is positively correlated with a distance from one of the outlets 615 corresponding to the second end 814*v* to the inlet 613*a*. In other words, as the distance from the outlet 615 to the inlet 613*a* increases, the second end 814*v* corresponding to the outlet 615 increases in size (e.g., the width, height or cross-sectional area of the second end 814*v*). Specifically, the first collector 810 includes a first outlet 615*a* and a second outlet 615*b*. The distribution groove 814 includes two second ends 814*v*1 and 814*v*2 at the first outlet 615*a* and the second outlet 615*b* respectively. Since a distance from the first outlet 615*a* to the inlet 613*a* is less than a distance from the second outlet 615*b* to the inlet 613*a*, a cross-sectional area F1 of the second end 814*v*1 is less than a cross-sectional area F2 of the second end 814*v*2.

Figure 7:
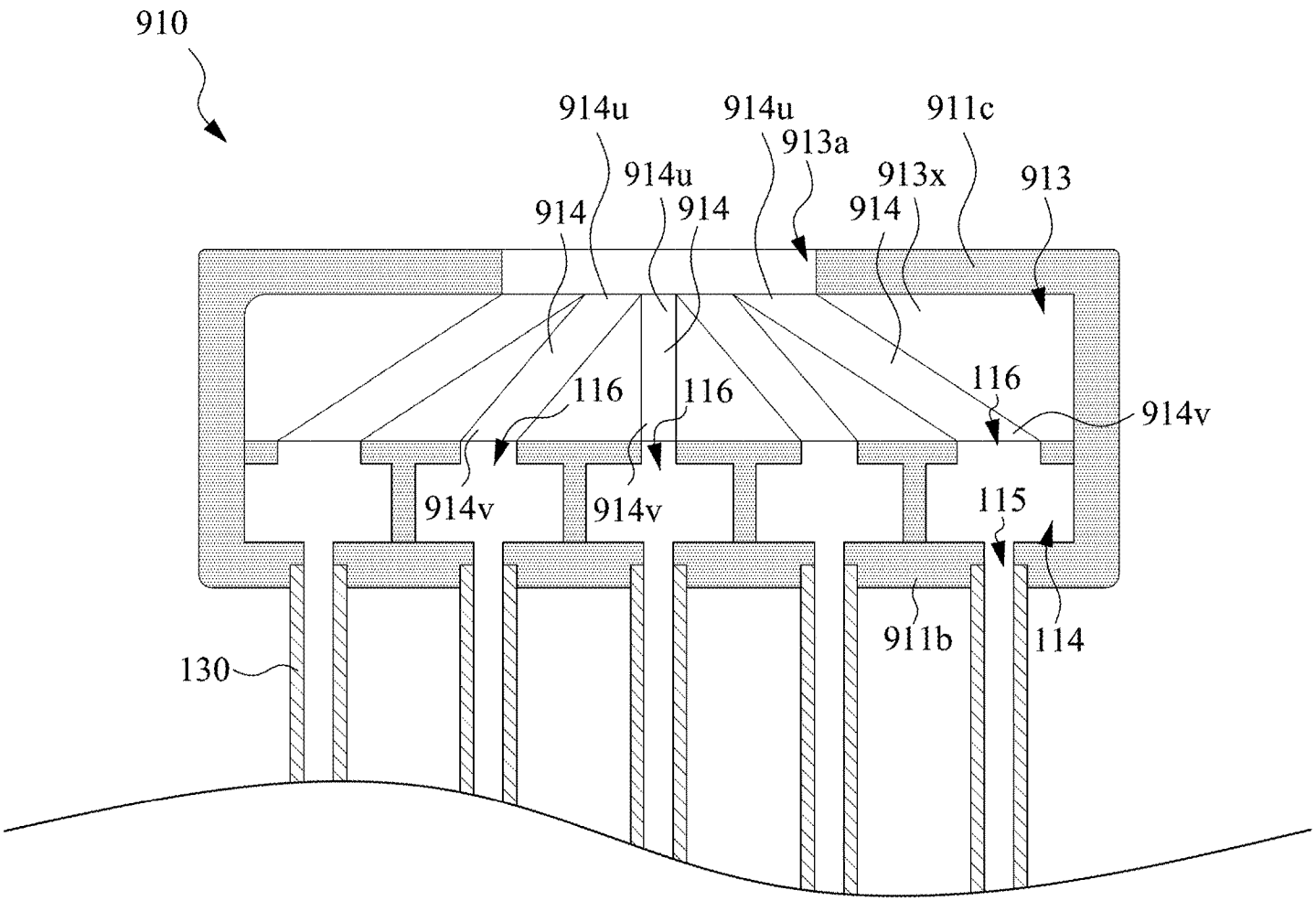
FIG. 7 illustrates an enlarged sectional view of a water cooling device in accordance with another embodiment of the present disclosure.

Reference is made to FIG. 7, which illustrates an enlarged sectional view of a water cooling device in accordance with another embodiment of the present disclosure. The present embodiment differs from the embodiment shown in FIG. 2 in that the inlet 913*a* and the outlets 115 of the first collector 910 located on opposite side walls 911*c* and 911*b* respectively. Additionally, compared to the embodiment shown in FIG. 2, the receiving chamber 913 of the first collector 910 is formed with at least one distribution groove 914. The distribution groove 914 has a first end 914*u* at the inlet 913*a* of the receiving chamber 913 and at least one second end 914*v* at the opening 116 of one of the distribution chambers 114.

The distribution groove 914 is preferably recessed into a wall portion 913*x* of the receiving chamber 913 (e.g., a top wall or a bottom wall the receiving chamber 913). Moreover, the receiving chamber 913 may include a plurality of distribution grooves 914. A size of the distribution groove 914 is positively correlated with a distance from the opening 115 corresponding to the distribution groove 914 to the inlet 913*a* of the receiving chamber 913. For example, when a distance from a first opening corresponding to a first distribution groove to the inlet 913*a* is greater than a distance from a second opening corresponding to a second distribution groove to the inlet 913*a*, the size of the first distribution groove is greater than that of the second distribution groove.

In addition, the distribution groove of the receiving chamber 913 may be shaped similar to the distribution groove 714 in FIG. 5 or the distribution groove 814 in FIG. 6. In some embodiments, a cross-sectional area of the distribution groove of the receiving chamber 913 increases with increasing distance from the inlet 913*a* of the receiving chamber 913. In some embodiments, the distribution groove of the receiving chamber 913 includes two or more second ends, and a size of the second end is positively correlated with a distance from the opening 116 corresponding to the second end to the inlet 913*a* of the receiving chamber 913. In other words, as said distance increases, the second end have increased size.

Figure 8:
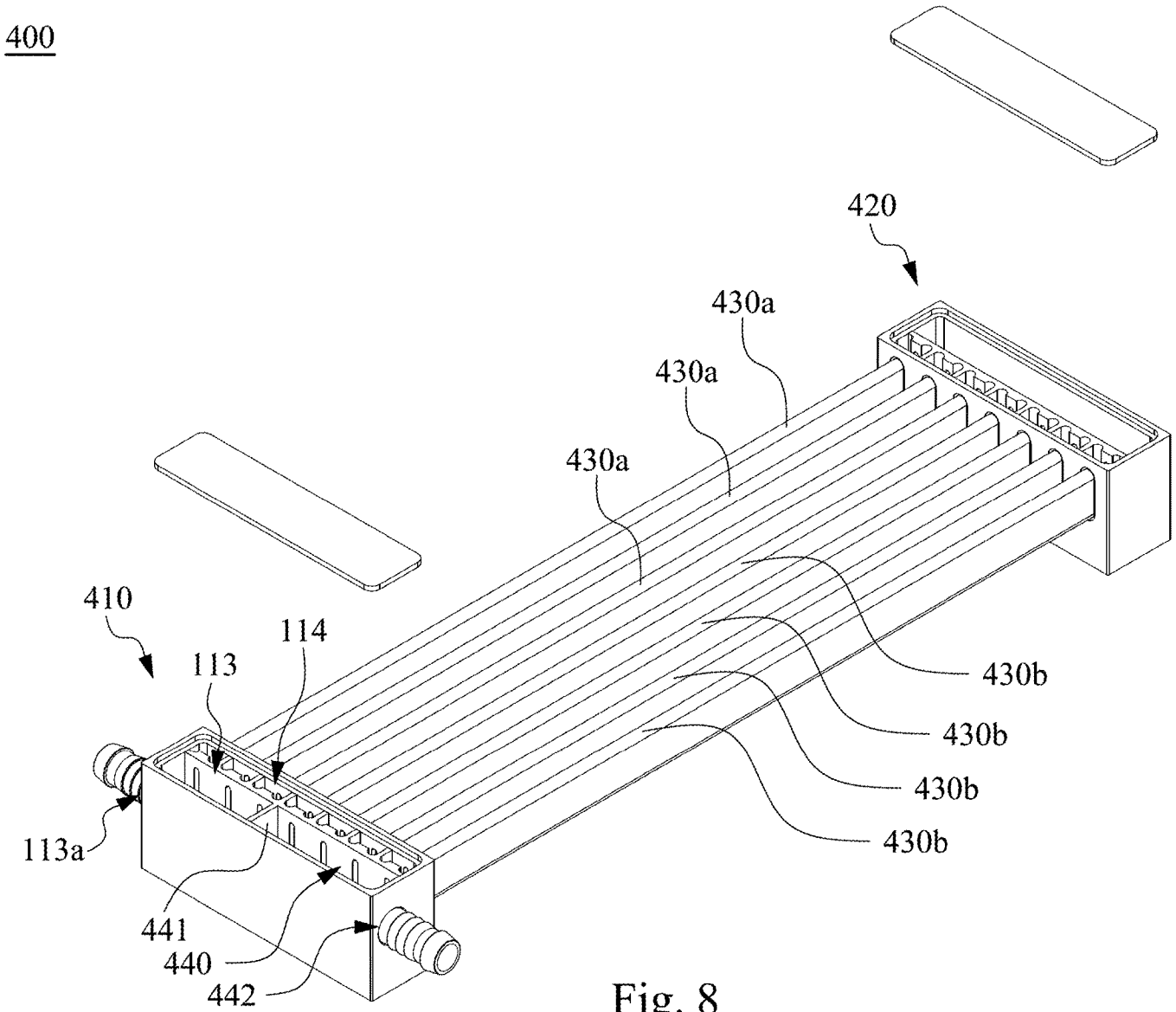
FIG. 8 illustrates an exploded view of a water cooling device in accordance with another embodiment of the present disclosure.

Reference is made to FIG. 8, which illustrates an exploded view of a water cooling device 400 in accordance with another embodiment of the present disclosure. In the present embodiment, the first collector 410 further includes a re-entrance chamber 440. The re-entrance chamber 440 and the receiving chamber 113 are separated by a partition 441. The re-entrance chamber 440 has an outlet 442 through which the working fluid exits the first collector 410. The water cooling device 400 includes one or more first tubes 430*a* and one or more first tubes 430*b*. Each of the first tubes 430*a* is connected to one of the distribution chambers 114 and the second collector 420 on its two ends respectively. Each of the first tubes 430*b* is connected to the re-entrance chamber 440 and the second collector 420 on its two ends respectively.

By this arrangement, the working fluid follows a generally U-shaped path to pass through the water cooling device 400. Specifically, the working fluid would first enter the receiving chamber 113 through the inlet 113*a*, and the working fluid is subsequently distributed into the first tubes 430*a* by the distribution chambers 114. The working fluid enters the second collector 420 after passing through the first tubes 430*a*. The working fluid then returns to the first collector 410 after passing through the first tubes 430*b* and flowing into the re-entrance chamber 440. At last, the working fluid exits the water cooling device 400 through the outlet 442.

In sum, the collector of the present disclosure utilizes distribution chambers or distribution grooves to evenly distribute the received working fluid to the outlets, thereby making the amount of working fluid passing through the tubes substantially equal.

Although the present disclosure has been described by way of the exemplary embodiments above, the present disclosure is not to be limited to those embodiments. Any person skilled in the art can make various changes and modifications without departing from the spirit and the scope of the present disclosure. Therefore, the protective scope of the present disclosure shall be the scope of the claims as attached.

What is claimed is:

1. A collector, comprising:

a receiving chamber having an inlet at a first side of the collector for receiving a working fluid; and a plurality of distribution chambers, wherein each of the plurality of distribution chambers comprises:

a first wall portion and a second wall portion, wherein the second wall portion is opposite from the first wall portion, and the first wall portion has an opening communicating with the receiving chamber, wherein the second wall portion has an outlet at a second side of the collector which is opposite the first side, and wherein a size of the opening of each distribution chamber is correlated with a distance from the opening to the inlet, such that the opening size is larger the further said opening is located from the inlet.

2. The collector of claim 1, wherein at least one of the distribution chambers further comprises a duct, and the duct protrudes from the first wall portion towards the second wall portion.

3. The collector of claim 1, wherein a number of the distribution chamber with the duct is two or more than two, and two of the ducts have differing diameters, cross-sectional areas, lengths or inner surface roughness.

4. The collector of claim 1, wherein the receiving chamber is formed with at least one distribution groove, the distribution groove has a first end at the inlet of the receiving chamber and at least one second end at the opening of one of the distribution chambers.

5. The collector of claim 4, wherein the distribution groove is recessed into a wall portion of the receiving chamber.

6. The collector of claim 4, wherein:

the at least one distribution groove is plural in number, and a size of the distribution groove is positively correlated with a distance from the opening corresponding to the distribution groove to the inlet of the receiving chamber;

a cross-sectional area of the distribution groove increases with increasing distance from the inlet of the receiving chamber; or the at least one second end is plural in number, and a size of the second end is positively correlated with a distance from the opening corresponding to the second end to the inlet of the receiving chamber.

* * * * *